United States Patent [19]

Mueller

[11] 4,451,301

[45] May 29, 1984

[54] ORGANIC PHOSPHATING SOLUTION FOR THE PHOSPHATING OF METALLIC SURFACES

[75] Inventor: Dieter J. Mueller, Marl, Fed. Rep. of Germany

[73] Assignee: Chemische Werke Huels AG, Marl, Fed. Rep. of Germany

[21] Appl. No.: 475,799

[22] Filed: Mar. 16, 1983

[30] Foreign Application Priority Data

Mar. 18, 1982 [DE] Fed. Rep. of Germany ..... 3209829

[51] Int. Cl.[3] ..... C23F 7/10

[52] U.S. Cl. ..... 148/6.15 R

[58] Field of Search ..... 148/6.15 R

[56] References Cited

U.S. PATENT DOCUMENTS

| | | | |
|---|---|---|---|
| 2,854,370 | 9/1958 | Kronstein | 148/6.15 R |
| 2,992,146 | 7/1961 | Low | 148/6.15 R |

FOREIGN PATENT DOCUMENTS

| | | | |
|---|---|---|---|
| 607061 | 10/1960 | Canada | 148/6.15 R |
| 690340 | 7/1964 | Canada | 148/6.15 R |

*Primary Examiner*—Sam Silverberg

*Attorney, Agent, or Firm*—Millen & White

[57] ABSTRACT

Homogeneous phosphating solutions comprise low-boiling halogenated hydrocarbons, aqueous phosphoric acid, methanol or an alcohol mixture consisting predominantly of methanol, nitroaromatics, ureas, optional conventional stabilizers, inhibitors, or accelerators, and, additionally, 0.01–2.0% by weight of formic acid esters as activating crystal nucleators.

15 Claims, 5 Drawing Figures

ORGANIC PHOSPHATING SOLUTION FOR THE PHOSPHATING OF METALLIC SURFACES

BACKGROUND OF THE INVENTION

The present invention relates to homogeneous organic phosphating solutions based on low-boiling halogenated hydrocarbons as the basic component.

These solutions conventionally additionally contain aqueous phosphoric acid as the phosphating agent, a low-boiling alcohol such as, for example, methanol, as the solubilizer, aromatic nitro compounds as hydrogen acceptors and/or accelerators, urea and urea derivatives as HCl acceptors and/or stabilizers.

It is known that metallic surfaces, especially those of iron and unalloyed steel, can be phosphated with aqueous phosphoric acid homogeneously dissolved in a halogenated hydrocarbon; i.e., analogously to the conventional Fe phosphating process

[see W. Rausch, "Die Phosphatierung von Metallen" [The Phosphating of Metals], Eugen G. Leuze Publishers, Saulgau (1974), page 103], such metallic surfaces can be coated with a surface layer of iron phosphates.

If the phosphate layer is to serve as a corrosion-inhibiting layer and/or as an inorganic primer coat for subsequent varnishing (painting or enameling), then certain requirements must be met by the layer properties. Thus, the layer thickness is to be at least 0.3 μm; furthermore, the layer is to be as uniform as possible, of low water solubility, firmly adhering, nonporous, and microcrystalline. The phosphate layer is to exhibit good corrosion-inhibiting properties and is to be a satisfactory adhesive substrate for subsequent varnishings.

Besides the necessary basic components, namely halogenated hydrocarbons, alcohols as solubilizers, and aqueous phosphoric acid, a number of other components are recommended. On the one hand, these act on the phosphating solution as stabilizers or inhibitors and, on the other hand, promote or attain, as accelerators or inhibitors, specific properties of the phosphate layers.

Thus, U.S. Pat. No. 3,228,806 mentions a series of quinones as stabilizers; U.S. Pat. No. 3,297,495 discloses a number of polyhydroxyaromatics; and U.S. Pat. No. 3,338,754 mentions, in addition to diisobutylene, substituted phenols as stabilizers.

Inhibitors are also mentioned sporadically, comprising according to U.S. Pat. No. 3,338,754, for example, classes of compounds as diverse as nitrobenzene, glacial acetic acid, and substituted alkyl thioureas.

Some of the aforementioned compounds are also combined under the generic term "accelerators", such as, for example, in DAS No. 2,611,790, which recites compounds such as dimethyl sulfoxide, pyridine, quinone, or amyl phenol. These compounds are disclosed as considerably accelerating the formation of the phosphate layers. U.S. Pat. No. 3,306,785 also discloses in this connection the presence of small amounts of zinc salts.

According to DAS No. 2,611,789 and DAS No. 2,611,790, undesirably grainy phosphate coatings are avoided by the presence of an aprotic compound, such as, in particular, N,N-dimethylformamide, but also dimethyl sulfoxide, acetonitrile, acetone, tetramethylenesulfone, and combinations thereof.

In order to improve the adhesive strength and to obtain dustless phosphate layers, DAS No. 1,222,351 suggests compounds of the type of dimethylglyoxime or indigo.

To improve the structure of the phosphate layers, European Patent Application No. 34,842 also discloses surface active materials with anionic or amphoteric character, such as, for example, salts of ethanolamine with fatty alcohol polyglycol ether carboxylic acids.

All of the additives in the phosphating solutions of the prior art have as a purpose the exertion of a favorable effect either on the corrosivity and stability of the phosphating solutions property, or on the formation and/or properties of the phosphate layers. The known additives in the latter field, however, have significant drawbacks. The conventional additives in all cases involve compounds which either exhibit, as liquids, a comparatively low vapor pressure, or must even be first dissolved in the phosphating solutions since they are solids. The additive components themselves, as well as their degradation products, therefore accumulate in the used phosphating solutions due to the low vapor pressure. Accordingly, they interfere, with the phosphating reaction, throughout the use of the same.

SUMMARY OF THE INVENTION

Consequently, it is an object of this invention to provide a phosphating solution having such an additive not exhibiting these disadvantages.

It is another object of the invention to provide such an additive having a promoting influence on the primary step, namely the activation of the metallic surface directly prior to the phosphating reaction, and having a predictable effect on the formation of the primary crystal on the surface.

Furthermore, it is yet another object of this invention to provide such an additive which has a comparatively high vapor pressure and, expecially during use of the phosphating solutions, is incapable of forming secondary products which, due to their enrichment in the bath, exert a disturbing influence.

Upon further study of the specification and appended claims, further objects and advantages of this invention will become apparent to those skilled in the art.

These objects have been achieved and this problem is solved, surprisingly, by providing homogeneous phosphating solutions comprising low-boiling halogenated hydrocarbons, aqueous phosphoric acids, an alcohol, preferably methanol or an alcohol mixture consisting predominantly of methanol, optionally, nitroaromatics, ureas, and, also optionally, other compounds conventional as stabilizers, inhibitors, or accelerators, etc. and, additionally, 0.01–2.0% by weight of formic acid esters as activating crystal nucleators.

DETAILED DESCRIPTION

Figure 1A:
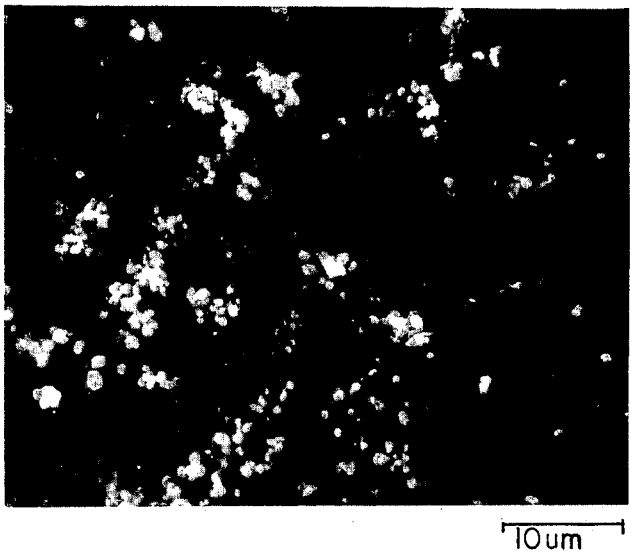
FIGS. 1*a*–1*c* are SEM photographs of a phosphate layer surface (see Table 1); Scale 2,000:1.

The phosphating solutions of this invention preferably contain the formic acid ester in a concentration of 0.1–1.0% by weight.

In another preferred embodiment of this invention, the phosphating solutions contain exclusively formic acid methyl ester as the formic acid ester.

The formic acid methyl ester is emphasized since it satisfies the aforedescribed requirements in an excellent fashion. It can be demonstrated that this ester promotes a denser phosphate crystal nucleation on the surface. Consequently, this ester can also be denoted as an especially useful activating crystal nucleator.

Another advantage of this ester resides in its physical and chemical characteristics which harmonically blend with the properties of low-boiling, organic phosphating solutions, for example, the phosphating solutions based on dichloromethane, methanol, and aqueous phosphoric acid. The other esters of this invention also display similar advantages. With a boiling point of 31.5° C., assurance is had that the ester cannot accumulate undesirably in the phosphating solution, usually having a boiling point of >35° C. Its chemical properties, moreover, ensure that no undesirable, high-boiling secondary products can be built up in the phosphating solution.

The comparatively high vapor pressure of this ester provides a further advantage, as also do the other esters of this invention. The gaseous phase in equilibrium with a boiling, ester-containing phosphating solution of this invention always exhibits marked ester concentrations. Thus, in the case of dip phosphating, the ester can act on the surfaces of the workpieces even prior to the actual phosphating process. In other words, if the workpieces, as usual, are first held above the phosphating bath in the gaseous phase of preheating purposes until no additional condensate runs off, then the workpieces are subjected to surface activation by the ester as early as during the preheating interval, without phosphating being conducted as yet. This additional activation in the vapor phase can also be advantageously exploited in the case of a multiple-dip phosphating process with intervals of workpiece suspension in the gaseous phase between the liquid phase dipping steps. In this regard, see U.S. application Ser. No. 475,798 now U.S. Pat. No. 4,447,273, of even date, which disclosure is incorporated by reference herein.

The activating crystal nucleation effect can also be attained by the likewise low-boiling formic acid ethyl ester, bp 54° C. In principle, though, the higher homologous formic acid esters are likewise suitable, because these esters, in methanol-containing phosphating baths, result in transesterification to the methyl ester under the catalytic effect of phosphoric acid. The use of the methyl ester, however, is preferred.

The phosphating solution of this invention contains from 0.01% to 2%, preferably 0.1% to 1.0%, of the formic acid ester. Contents lower than 0.01% are hardly effective; contents higher than 2% increasingly lead to undesirable crystal buildup characterized by crystal blooming on the metallic surface.

In the following description of the phosphating solution according to this invention, the contents of the individual ingredients are indicated in percent by weight. The phosphating solution is a homogeneous solution which comprises all of or conventionally selected members of the following individual components.

Suitable primary solvents include low-boiling halogenated hydrocarbons, such as: dichloromethane, chloroform, trichlorofluoromethane, dichloroethane, trichloroethylene, 1,1,1-trichloroethane, 1,1,3-trichlorotrifluoroethane, or a mixture thereof.

Low-boiling alcohols which can be utilized as solubilizers include: methanol, ethanol, isopropanol, propanol, butanol, sec-butanol, tert-butanol, n-pentanol, sec-pentanol, hexanol, and mixtures thereof, e.g., a $C_{1-6}$-alkanol.

Ureas which can be used include: urea, dimethylurea, diethylurea, and other alkylated ureas, e.g., wherein the alkyl groups have 1–4 C-atoms, and mixtures thereof. Suitable nitroaromatics include: nitrobenzene, dinitrobenzene, nitrotoluene, dinitrotoluene, nitroethylbenzene, or a mixture thereof, e.g., in general, nitrobenzenes optionally substituted by $C_{1-4}$-alkyl.

Additional stabilizers which can optionally be used include: quinones, phenols, nitrophenols, and nitromethane.

The following compounds are optionally suitable as additional inhibitors: nitroureas, thioureas, methylthiourea, ethylthiourea, dimethylthiourea, diethylthiourea, and alkylated thioureas.

Suitable as additional accelerators are optionally the following compounds: pyridine and picric acid.

The primary solvent will be present, in general, in an amount of 60–85% by weight, preferably 70–80% by weight, based on the amount of the entire phosphating solution. The aqueous phosphoric acid should be employed in such a quantity that a $H_3PO_4$ concentration of 0.1–2.0% by weight, preferably 0.3–1.0% by weight is present, also based on the total amount of phosphating solution. The concentration of the water in the phosphating solution should be 0.5–7% by weight, preferably 3.0–6.0% by weight.

Methanol or a mixture of alcohols with a predominant proportion of methanol (e.g., above 50 wt %) serves as the solubilizer. The concentration of the methanol, or of the alcohol mixture with a predominant methanol proportion, should be 10–30% by weight, preferably 15–25% by weight, based on the entire phosphating solution.

Ureas should be used in a concentration of 0.01–1.0% by weight, preferably 0.05–0.5% by weight, based on the entire phosphating solution. Nitroaromatics can be used in a concentration of 0.01–1.0% by weight, preferably 0.05–0.5% by weight, based on the entire phosphating solution.

The additional accelerators, stabilizers, and inhibitors can each be present in a concentration of 0.01–1.0% by weight, preferably 0.05–0.5% by weight, based on the entire phosphating solution.

The formic acid ester of a $C_{1-12}$-alkanol can be present in a concentration of 0.01–2.0% by weight, preferably 0.1–1.0% by weight, based on the entire phosphating solution. Usable as the formic acid ester is preferably formic acid methyl ester, but it is possible also to employ formic acid ethyl ester, propyl ester, isopropyl ester, butyl ester, sec-butyl ester, and tert-butyl ester, or mixtures thereof. As higher homologous formic acid esters, the following are also suitable, for example: formic acid n-pentyl ester, sec-pentyl ester, n-hexyl ester, sec-hexyl ester, heptyl ester, n-octyl ester, 2-ethylhexyl ester, nonyl ester, decyl ester, undecyl ester, dodecyl ester. The esters preferably contain 1 to 4 carbon atoms in the alcohol portion.

Typical formulations of phosphating baths according to this invention, based on low-boiling halogenated hydrocarbons, include the following (percentages are weight percent in all cases):

74% $CH_2Cl_2$, 20% $CH_3OH$, 5% $H_2O$, 0.7% $H_3PO_4$, 0.1% 2,4-dinitrotoluene, 0.1% urea, 0.3% $HCOOCH_3$ 73% $CH_2Cl_2$, 21% $CH_3OH$, 5% $H_2O$, 0.7% $H_3PO_4$, 0.1% 1,3-dinitrobenzene, 0.1% urea, 0.1% $HCOOCH_3$ 72% $CCl_3CF$, 22% $CH_3OH$, 4.5% $H_2O$, 0.8% $H_3PO_4$, 0.2% urea, 0.1% 1,3-dinitrobenzene, 0.3% $HCOOCH_3$ 70% $CH_3CCl_3$, 24.5% $C_2H_5OH$, 4% $H_2O$, 0.7% $H_3PO_4$, 0.1% dimethylurea, 0.1% 2,4-dinitrotoluene, 0.6% $HCOOCH_3$ 35% $CH_2Cl_2$, 36% $CCl_3CF_3$, 20% $CH_3OH$, 4% i-$C_3H_7OH$, 4.0% $H_2O$, 0.6% $H_3PO_4$, 0.1% 2,4-dinitrotoluene, 0.1% urea, 0.2% $HCOOCH_3$.

Unless indicated otherwise herein, all details of the solutions of this invention and their use are conventional and are disclosed in DAS No. 2.611.790 and EP-A 34 842. Typically, the treated metallic surface is an iron surface, e.g., unalloyed steel qualities as described in DIN 1623 as well as zinc, manganese, or aluminum.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

The surprising effect of the phosphating solutions according to this invention is shown with the aid of the examples set forth below.

The test workpieces are low-carbon, cold-rolled deep-drawn sheets St 1405 having the dimensions of 10×20 cm, steam-degreased or dip-degreased by means of commercial metal degreasing baths. These test sheets, after degreasing, are weighed in the dry condition and then subjected to dip-phosphating.

The phosphating vessel is a heatable jacketed container, filled to about one-half with phosphating solution and equipped, to avoid evaporation losses, at the upper rim with cooling coils and with a lid with a cutout for a dipping device.

The comparative tests represent the state of the art as known from DAS No. 2,611,789 and DAS No. 2,611,790.

EXAMPLE 1

The aforedescribed steel sheets are first preheated in the gaseous phase prevailing above the boiling phosphating solution, until there is no longer any runoff of condensate; the sheets are then phosphated by dipping into the phosphating solutions set forth in Table 1. The dipping period is selected to be 60 seconds. After phosphating, the sheets can optionally be additionally sprayed with the condensate of the gaseous phase, and thereafter the sheets are lifted through the cooling zone into the atmosphere, thus being dried immediately. The sheets, after determining the increase in mass, are subjected to a scanning electron microscope examination (SEM) to test the microcrystallinity and the uniform distribution of the crystals adhering to the metallic surface.

The sheets are furthermore subjected to test paintings with various varnish systems based on an alkyd resin (air-drying), an alkyd-melamine resin (baking enamel), and an epoxy resin (bicomponent system). The dry paint layers have a uniform thickness of about 30 μm. The thus-coated sheets are subjected, after having been scratched, to a salt spray mist test according to DIN [German Industrial Standard] 50 021 and DIN 53 167, and thereafter the extent of hidden rusting is determined.

The way in which the test is conducted, and the results thereof, can be seen from Table 1.

Figure 1B:
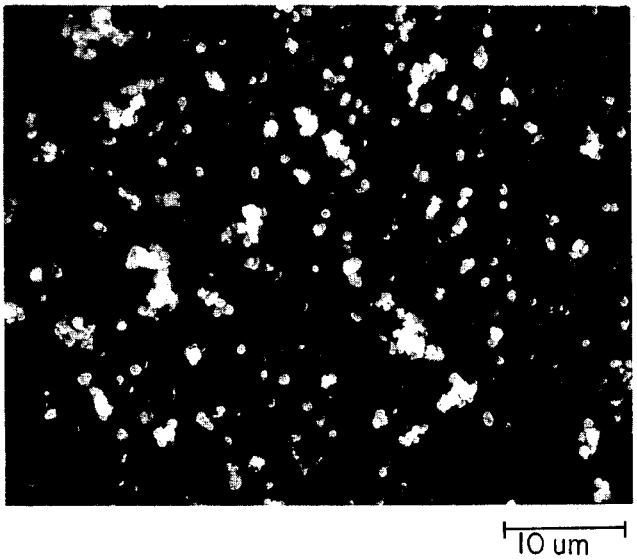
Figure 1C:
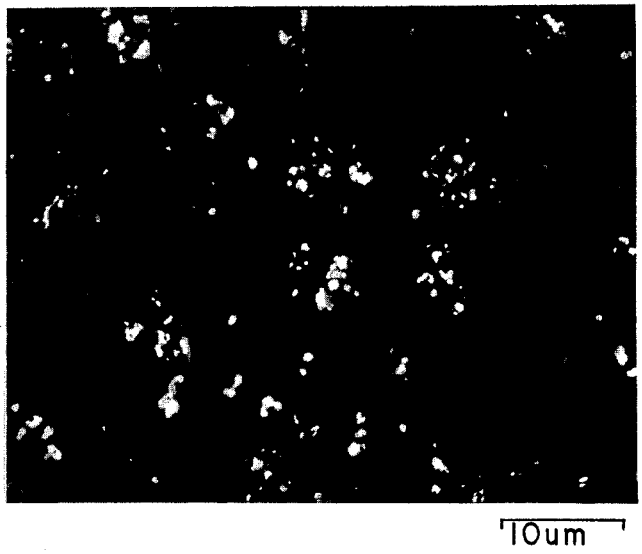

FIGS. 1*a*, 1*b*, and 1*c* show SEM photos as examples, documenting that the presence of the formic acid methyl ester brings a marked improvement in the microcrystalline structure of the phosphate layer, and that the crystallites are more uniformly distributed. With an ester content of 2%, spotwise, undesirable crystalline blooms can clearly be seen on the surface.

Table 1 demonstrates that the corrosion-inhibiting properties of the phosphate layers are quite considerably improved by the presence of formic acid esters in the phosphating bath. (The corrosion-protective properties were tested on selected test sheets after varnishing by a salt spray mist test.)

EXAMPLE 2

The phosphating solutions indicated in Table 2 are used for phosphating steel sheets, corresponding to Example 1, after preheating by dipping with a dipping time of 60 seconds, thus achieving the results set forth in Table 2.

Here again, a markedly improved crystallinity (SEM) and a considerably enhanced corrosion protection of the resultant phosphate layer (DIN salt spray mist test) is evident with the presence of formic acid methyl ester in the phosphating solution.

EXAMPLE 3

The phosphating solutions set forth in Table 3 are used for phosphating steel sheets in accordance with Example 1 after preheating by dipping with a dipping time of 60 seconds, thus attaining the results shown in Table 3. Here, too, the improvement in phosphate layer quality by the presence of the formic acid methyl ester is clearly apparent.

TABLE 1

Phosphating of Steel Sheets in Various Phosphating Solutions with Addition of Formic Acid Methyl Ester

| Phosphating and Testing Methods | Data and Results (Percentages = Weight Percent) | | | | | |
|---|---|---|---|---|---|---|
| Phosphating Bath | 20.0% $CH_3OH$; 0.1% Dinitrotoluene; 5.0% $H_2O$; 0.70% $H_3PO_4$; 0.1% Urea; 0–2.0% Formic Acid Methyl Ester; Rest $CH_2Cl_2$ | | | | | |
| | Formic Acid Ester (%) | | | | | |
| | 0 | 0.05 | 0.3 | 0.5 | 1.0 | 2.0 |
| | For Comparison | According to Invention | | | | |
| Dipping Time [sec] | 60 | 60 | 60 | 60 | 60 | 60 |
| Average Mass Increase [mg/m²] | 1,630 | 1,630 | 1,750 | 1,730 | 1,700 | 1,600 |
| Scanning Electron Microscope Photograph [SEM] | FIG. 1a | | | | FIG. 1b | FIG. 1c |
| Varnish Structure for Testing | Air-Drying Alkyd Resin Primer Coat, One Layer, 30 μm | | | | | |

TABLE 1-continued

| Phosphating of Steel Sheets in Various Phosphating Solutions with Addition of Formic Acid Methyl Ester | | | | | | |
|---|---|---|---|---|---|---|
| Phosphating and Testing Methods | Data and Results (Percentages = Weight Percent) | | | | | |
| DIN Salt Spray Mist Test Average Range of Hidden Rust after 240 Hours [mm] | 3.0 | 2.6 | 1.8 | 1.6 | 1.6 | 1.8 |

TABLE 2

Figure 2A:
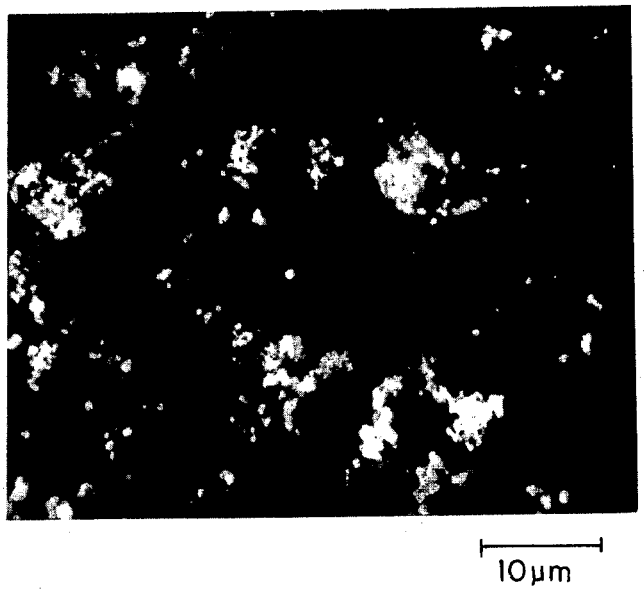
FIGS. 2*a* and 2*b* are also SEM photographs of a phosphate layer surface (see Table 2); Scale 2,000:1.
Figure 2B:
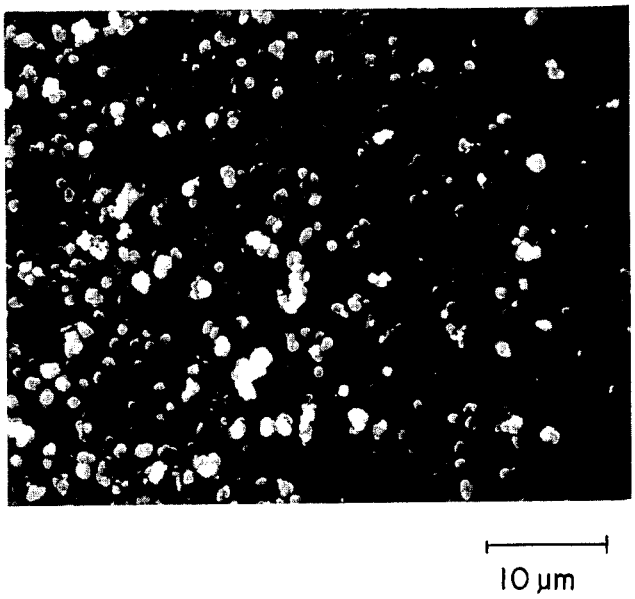

| Phosphating of Steel Sheets in Various Phosphating Solutions with Addition of Formic Acid Methyl Ester | | | |
|---|---|---|---|
| Phosphating and Testing Methods | Data and Results (Percentages = Weight Percent) | | |
| Phosphating Bath | 20.5% $CH_3OH$; 0.1% Dinitrobenzene; 5.0% $H_2O$; 0.7% $H_3PO_4$; 0–0.5% Formic Acid Methyl Ester Rest: $CH_2Cl_2$ | | |
| | Formic Acid Ester (%) | | |
| | 0 | 0.1 | 0.5 |
| | For Comparison | According to Invention | |
| Dipping Time [sec] | 60 | 60 | 60 |
| Average Mass Increase [mg/m$^2$] | 1,020 | 1,100 | 1,150 |
| Scanning Electron Microscope Photograph [SEM] | FIG. 2a | | FIG. 2b |
| Varnish Structure for Testing | Baking Enamel Based on Alkyd-Melamine Resin One Layer, 30 μm | | |
| DIN Salt Spray Mist Test Average Range of Hidden Rust after 240 Hours [mm] | 4.0 | 3.1 | 2.5 |

TABLE 3

| Phosphating of Steel Sheets in Various Phosphating Solutions with Addition of Formic Acid Methyl Ester | | |
|---|---|---|
| Phosphating and Testing Methods | Data and Results (Percentages = Weight Percent) | |
| Phosphating Bath | 20.0% $CH_3OH$; 0.1% Nitrobenzene; 5.0% $H_2O$; 0.7% $H_3PO_4$; 0.1% Urea; 0–0.5% Formic Acid Methyl Ester; Rest $CH_2Cl_2$ | |
| | Formic Acid Ester (%) | |
| | 0 | 0.5 |
| | For Comparison | According to Invention |
| Dipping Time [sec] | 60 | 60 |
| Average Mass Increase [mg/m$^2$] | 960 | 1,010 |
| Varnish Structure for Testing | Bicomponent Epoxy Resin Primer, One Layer 30 μm | |
| DIN Salt Spray Mist Test Average Range of Hidden Rust after 240 Hours | 3.0 | 2.1 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A homogeneous phosphating solution comprising effective amounts of a low-boiling halogenated hydrocarbon; aqueous phosphoric acid; methanol or a $C_{1-6}$ alkanol mixture predominantly comprising methanol; an optional stabilizer; an optional inhibitor; an optional accelerator; and 0.01–2.0% by weight of a formic acid ester of a $C_{1-12}$-alkanol as an activating crystal nucleator.

2. A solution of claim 1, comprising an effective amount of a nitrobenzene or a nitrobenzene substituted by $C_{1-4}$-alkyl, and urea or a $C_{1-4}$-alkylurea.

3. A solution of claim 2, wherein the amount of formic acid ester is 0.1–1% by weight.

4. A solution of claim 2, wherein the formic acid ester is methyl formate.

5. A solution of claim 3, wherein the formic acid ester is methyl formate.

6. A solution of claim 2, wherein the formic acid ester is ethyl formate.

7. A solution of claim 2, wherein the halogenated hydrocarbon is dichloromethane, chloroform, trichlorofluoromethane, dichloroethane, trichloroethylene, 1,1,1-trichloroethane, 1,1,3-trichlorotrifluoroethane, or a mixture thereof.

8. A solution of claim 2, wherein the urea compound is urea, dimethylurea or diethylurea or a mixture thereof and its nitrobenzene compound is nitrobenzene, dinitrobenzene, nitrotoluene, dinitrotoluene, nitroethylbenzene, or a mixture thereof.

9. A solution of claim 2, wherein the amounts of ingredients are as follows in weight percent:

Halogenated hydrocarbon: 60–85%

Phosphoric acid: 0.1–2.0%

Water: 0.5–7%

Methanol or alkanol mixture: 10–30%

Urea compound: 0.01–1.0%

Nitrobenzene compound: 0.01–1.0%.

10. A solution of claim 9, further comprising 0.01–1.0 wt % of each of a stabilizer, an inhibitor and an accelerator.

11. A solution of claim 9, further comprising 0.05–0.5 wt % of each of a stabilizer, an inhibitor and an accelerator.

12. A solution of claim 2, wherein the formic acid ester is an ester of a $C_{1-14}$-alkanol.

13. A solution of claim 2, wherein the halogenated hydrocarbon is dichloromethane.

14. In a method of phosphating a metallic surface by treating the same with a phosphating solution, the improvement wherein the solution is that of claim 1.

15. In a method of phosphating a metallic surface by treating the same with a phosphating solution, the improvement wherein the solution is that of claim 2.

* * * * *